US009267210B2

(12) United States Patent
Krall

(10) Patent No.: US 9,267,210 B2
(45) Date of Patent: Feb. 23, 2016

(54) PICKLE LINE ASSEMBLY WITH INCLINED EXPANSION SEAL

(75) Inventor: Thomas Wilbert Krall, Avella, PA (US)

(73) Assignee: Siemens Industry, Inc., Alpharetta, GA (US)

( * ) Notice: Subject to any disclaimer, the term of this patent is extended or adjusted under 35 U.S.C. 154(b) by 988 days.

(21) Appl. No.: 12/824,684

(22) Filed: Jun. 28, 2010

(65) Prior Publication Data

US 2011/0023916 A1 Feb. 3, 2011

Related U.S. Application Data

(60) Provisional application No. 61/229,604, filed on Jul. 29, 2009.

(51) Int. Cl.
*C23G 3/02* (2006.01)

(52) U.S. Cl.
CPC ..... *C23G 3/021* (2013.01); *C23G 3/025* (2013.01); *C23G 3/027* (2013.01); *C23G 3/029* (2013.01)

(58) Field of Classification Search
CPC ..... C23G 3/02; C23G 3/021; C23G 3/024; C23G 3/027; C23G 3/029; C23G 3/025; C23G 3/026; B08B 3/041; F16J 15/02
USPC ..... 134/64 R, 83, 133, 122 R, 199, 104.1, 134/112; 141/86, 88, 346, 369, 372–373, 141/386; 413/9; 403/73, 75, 9, 243, 241, 403/3.6, 4.32, 4.12, 618; 277/608–609, 277/636, 647, 603, 626
See application file for complete search history.

(56) References Cited

U.S. PATENT DOCUMENTS 184,599 A * 11/1876 Ehrhardt ..... 24/456
3,648,593 A * 3/1972 Marshall ..... 454/67
4,397,451 A * 8/1983 Kinoshita et al. ..... 266/252

(Continued)

FOREIGN PATENT DOCUMENTS

CN 201144287 Y 11/2008
CN 201169627 Y 12/2009

(Continued)

OTHER PUBLICATIONS

Translation of corresponding Russian Office Action dated Apr. 16, 2013 for Russian Application No. 2012102769 (14 pages).

(Continued)

*Primary Examiner* — Joseph L Perrin
*Assistant Examiner* — Kevin G Lee
(74) *Attorney, Agent, or Firm* — Gesmer Updegrove LLP

(57) ABSTRACT

A pickle line assembly is provided having a roll tank, a pickle tank, and an expansion seal. The roll tank includes a front and rear face that are angled towards one another at the upper end. The pickle tank includes front and rear openings, which can be brought into registration with an opening in the front face and rear face of the roll tank. Expansion seals are configured to surround a perimeter of the pickle tank substantially near the front and rear openings, and are angled at approximately the same angle as the front and rear face of the roll tank. The expansion seal encloses the path between the pickle tank and roll tank, and the tilt angle of the front and rear face of the roll tank allow the pickle tank to be vertically raised and lowered into position without interference.

10 Claims, 7 Drawing Sheets

(56) References Cited

U.S. PATENT DOCUMENTS

| | | | | | |
|---|---|---|---|---|---|
| 4,756,829 | A | * | 7/1988 | Bohringer | 210/241 |
| 4,807,653 | A | * | 2/1989 | Cipriano et al. | 134/64 R |
| 4,956,525 | A | * | 9/1990 | Wilk | 174/152 R |
| 4,996,998 | A | * | 3/1991 | Seiz et al. | 134/60 |
| 5,248,372 | A | * | 9/1993 | McNamee | 156/345.2 |
| 5,312,490 | A | * | 5/1994 | Wilkinson | 118/733 |
| 5,566,694 | A | * | 10/1996 | Pugh et al. | 134/64 R |
| 5,903,954 | A | * | 5/1999 | Gajewski | 15/302 |
| 6,427,706 | B1 | * | 8/2002 | Wissmann et al. | 134/64 R |
| 6,926,283 | B2 | * | 8/2005 | Janoff et al. | 277/603 |
| 2004/0099292 | A1 | * | 5/2004 | Volz et al. | 134/104.2 |

FOREIGN PATENT DOCUMENTS

| | | | |
|---|---|---|---|
| EP | 1035233 | A1 | 9/2000 |
| JP | S51132393 | A | 11/1976 |
| JP | S58185782 | A | 10/1983 |
| JP | H01240490 | A | 9/1989 |
| JP | H02186295 | A | 7/1990 |
| JP | H0688254 | A | 3/1994 |
| JP | H09228083 | A | 9/1997 |
| JP | H11302884 | A | 11/1999 |
| JP | 2005097673 | A | 4/2005 |
| SU | 745561 | A1 | 7/1980 |
| SU | 1335575 | A1 | 9/1987 |

OTHER PUBLICATIONS

Translation of corresponding Japanese Office Action dated Jul. 9, 2013 for Japanese Application No. 2012522906 (7 pages).

Translation of corresponding Chinese Office Action dated Apr. 23, 2013 for Chinese Application No. 201080033852.0 (14 pages).

PCT International Search Report mailed Oct. 21, 2010 corresponding to PCT International Application No. PCT/US2010/042864 filed Jul. 22, 2010 (9 pages).

International Preliminary Report on Patentability corresponding to PCT International Application No. PCT/US2010/042864 filed Jul. 22, 2010 (8 pages).

* cited by examiner

PICKLE LINE ASSEMBLY WITH INCLINED EXPANSION SEAL

This application claims the benefit of U.S. Provisional Patent Application No. 61/229,604, filed Jul. 29, 2009, which is incorporated herein by reference.

FIELD OF THE INVENTION

The present invention is generally directed to a pickle line assembly, and more particularly to an apparatus for pickling having an inclined expansion seal between apparatus components.

BACKGROUND OF THE INVENTION

Pickling is the process of chemically removing oxides and scale from the surface of a metal by the action of water solutions or inorganic acids ("pickling solution"). A typical pickling apparatus includes multiple pickle tanks. The pickle tanks are filled with the pickling solution, such that, as the metal being processed is fed through the pickle tanks, the metal is submerged in the pickling solution. The exposure of the metal to the pickling solution is determined by the length of the pickle tank, the rate at which the metal is fed through the pickle tank, and the number of pickle tanks in the assembly.

As the metal, or pickling material, is moved through the tanks, the pickling solution may splash or overflow within a pickle tank. Splashing and overflow can allow the hazardous pickling solution and fumes to escape the tank. Additionally, the materials frequently used to form pickling tanks (e.g., polypropylene) experience significant expansion and contraction from changes in temperature, thereby allowing the pickling solution and fumes to leak from the pickle tank, especially at the seam between the pickle tank and roll tank.

In addition to splashing and leaking pickling solution, traditional pickle line assemblies are open at the top between the pickle tanks and roll tank. After the pickle tank has been moved into position with the roll tank, closure plates are typically attached to the assembly to cover the top opening between the pickle tank and roll tank. The closure plates can reduce the amount of pickling solution escaping the boundaries of the pickling line assembly, and can contain the fumes from the pickling solution. The necessity of closure plates increases assembly and installation time of the pickle line assembly. Furthermore, despite the closure plates, an annular open space remains around the perimeter of the intersection of the pickle tank and the roll tank from which pickling solution and fumes can escape.

SUMMARY OF THE INVENTION

In accordance with an embodiment of the present invention, a pickle line assembly is provided comprising a roll tank, a pickle tank, and an expansion seal. The roll tank includes a front face and rear face that are angled such that the upper ends of the front and rear face are closer together than a lower end of the front face and a lower end of the rear face. The front face and the rear face each have an opening for receiving a pickling material. The pickle tank includes an internal cavity for transport of the pickling material and a front opening and a rear opening through which the pickling material can pass into or out of the roll tank. An expansion seal is provided for the interface of the pickle tank and the respective front and rear face of the roll tank. The expansion seal is configured to surround a perimeter of the pickle tank substantially near the respective front and rear opening and includes an outward-facing surface angled at approximately the same angle as the respective front face and rear face of the roll tank. When assembled, the front opening of the pickle tank is in registration with the opening of the front face of a first roll tank such that the front expansion seal encloses a path between the pickle tank and the first roll tank, and the rear opening of the pickle tank is in registration with the opening of the rear face of a second roll tank such that the rear expansion seal encloses a path between the pickle tank and the second roll tank.

In accordance with a further embodiment of the present invention, a pickle tank is provided. The pickle tank includes an internal cavity for transport of the pickling material and a front and rear opening defining a length of the pickle tank. The pickle tank further includes a front and rear expansion seal configured to surround a perimeter of the respective front and rear openings. Each expansion seal is angled relative to vertical such that an upper portion of the front expansion seal is further away from a midpoint of the length of the pickle tank relative to a lower portion of the front expansion seal. Additionally, each expansion seal includes an outward-facing surface configured to interface a roll tank such that the opening of the pickle tank would be in registration with an opening in the roll tank.

In accordance with yet a further embodiment of the present invention, a roll tank is provided. The roll tank includes a front face and a rear face, each having an opening for receiving a pickling material and angled relative to vertical such that an upper end of the front face and an upper end of the rear face are closer than a lower end of the front face and a lower end of the rear face. The roll tank further includes a front expansion seal and a rear expansion seal coupled to the respective front face and rear face at an angle relative to vertical that is substantially similar to the angle of the respective front face and rear face. Each expansion seal substantially surrounds a perimeter of the opening of the respective front and rear face and is configured to allow a pickle tank to be vertically lowered into registration with the openings of the front and rear face without interference from the respective front and rear expansion seal.

These and other advantages of the invention will be apparent to those of ordinary skill in the art by reference to the following detailed description and the accompanying drawings.

DETAILED DESCRIPTION

Figure 1B:
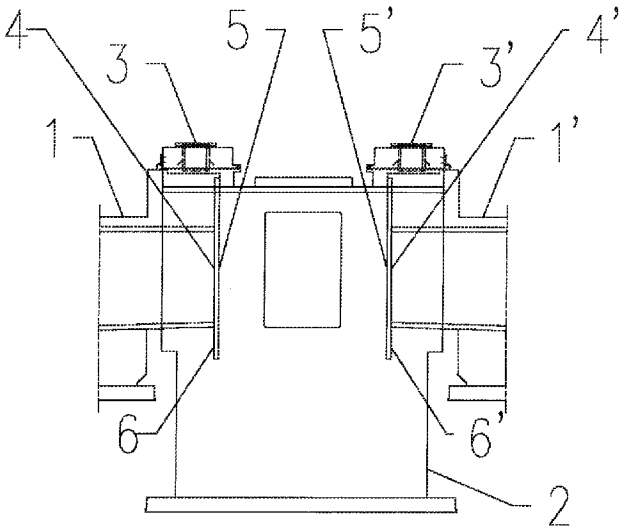
FIG. 1B is an elevation view of the portion of a pickle line assembly illustrated in FIG. 1A.
Figure 1A:
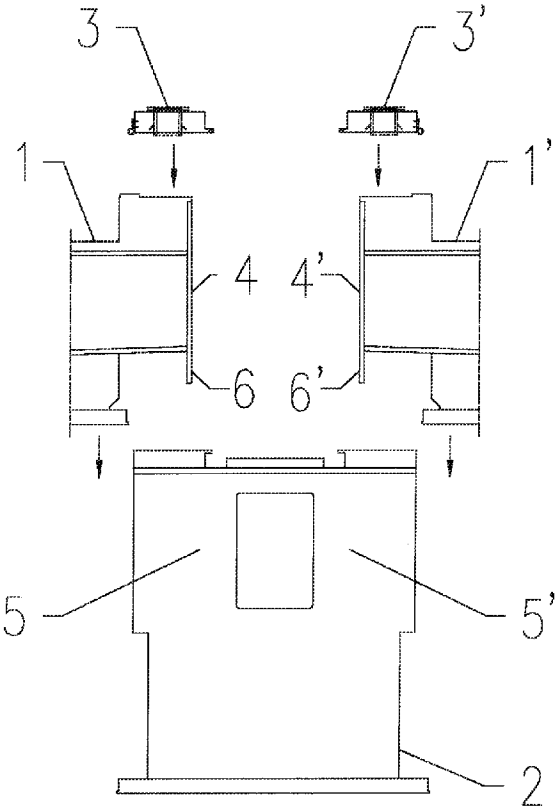
FIG. 1A is an exploded elevation view of a portion of a pickle line assembly.

FIGS. 1A and 1B illustrate a section of a pickling apparatus. FIG. 1A illustrates two pickle tanks 1 and 1' prior to being attached to a roll tank 2. The pickle tanks 1 and 1' are lowered into registration with the roll tank 2, such that openings 4 and 4' at the end of the pickle tanks 1 and 1', respectively, are in registration with openings 5 and 5' of roll tank 2, so as to feed into the roll tank 2. FIG. 1B illustrates the section of the pickling apparatus shown in FIG. 1 after assembly. That is, FIG. 1B shows both pickle tanks 1 and 1' in registration with the roll tank 2 such that the openings at the ends of the pickle tanks 4 and 4' are in registration with the openings 5 and 5' of the roll tank 2.

In the pickle tank assemblies illustrated in FIGS. 1A and 1B, the openings at the end of the pickle tanks 1 and 1' are U-shaped such that the top of the openings are not covered. Pickle tanks 1 and 1' further include flanges 6 and 6', which extend into the opening of roll tank 2 and create a labyrinth seal to reduce the amount of solution that splashes into the intersection between the tanks After the pickle tanks 1 are lowered into registration with the roll tank 2, closure plates 3 and 3' are attached to the assembly to cover the opening.

Figure 2A:
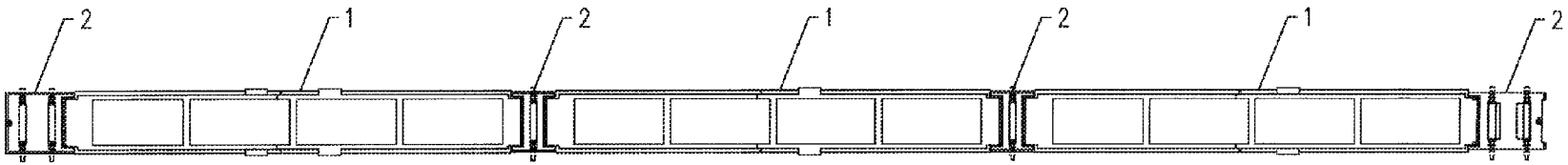
FIG. 2A is a top plan view of a pickle line assembly installation sequence.
Figure 2B:
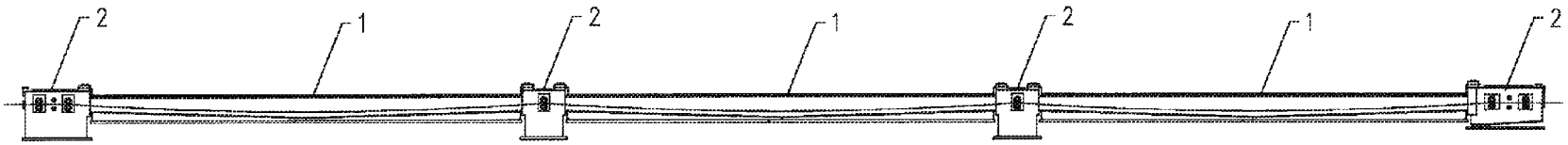
FIG. 2B is an elevation view of the pickle line assembly installation sequence illustrated in FIG. 2A.

FIG. 2A is a plan view of a pickle line arrangement, and FIG. 2B is an elevation view of the same pickle line arrangement. In FIGS. 2A and 2B, pickle tanks 1 are in registration with and separated by roll tanks 2. Thus, any metal being processed by this assembly would pass through multiple pickle tanks and roll tanks.

Figure 2C:
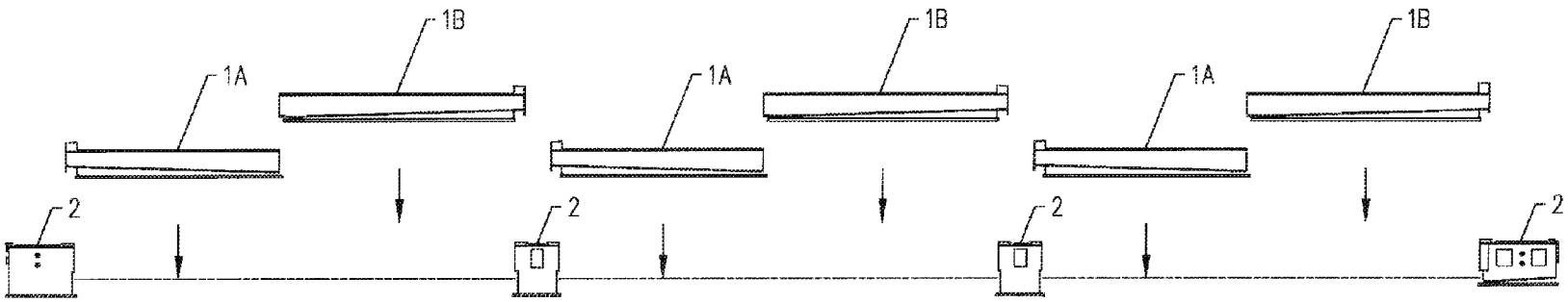
FIG. 2C is an elevation view of the pickle line assembly installation sequence illustrated in FIG. 2A during elevation of the pickle tanks.

FIG. 2C illustrates the pickle line arrangement of FIGS. 2A and 2B with the pickle tanks 1 decoupled from the roll tanks 2. In this arrangement, it can be seen that each pickle tank 1 can include an entry section 1*a* and an exit section 1*b*. The entry section 1*a* and the exit section 1*b* are connected to form a pickle tank 1.

As can be seen in FIGS. 1A-1B and 2A-2C, the ends of the pickle tank 1 are substantially vertical. Similarly, the wall around the opening of the roll tank 2 is also vertical so as to abut against the opening of the pickle tank 1, with flanges 6 and 6' extending into the openings of roll tank 2. The resulting openings at the top of the roll tank is covered with closure plates 3 and 3'

Assembly of the pickle line is time consuming since each connection between a pickle tank 1 and a roll tank 2 requires confirmation of alignment and attachment of the closure plates. Additionally, an annular open space remains around the perimeter of the intersection of the pickle tank and the roll tank from which pickling solution and fumes can escape from the tanks.

Moreover, as the temperature fluctuates in and around the pickling assembly, either due to changes in ambient temperature or as a result of heating the solution of the pickling process, the pickle tanks 1 and 1' and roll tank 2 experience expansion and contraction, which can cause the interface between the pickle tanks 1 and 1' and the roll tank 2 to leak. Rigidly attaching the pickle tanks 1 and 1' to roll tank 2, for example using bolts, would result in catastrophic failure of the connection between the pickle tanks 1 and 1' and the roll tank 2 due to the effects of thermal deformation and therefore does not prevent leakage from the pickling assembly.

Figure 3A:
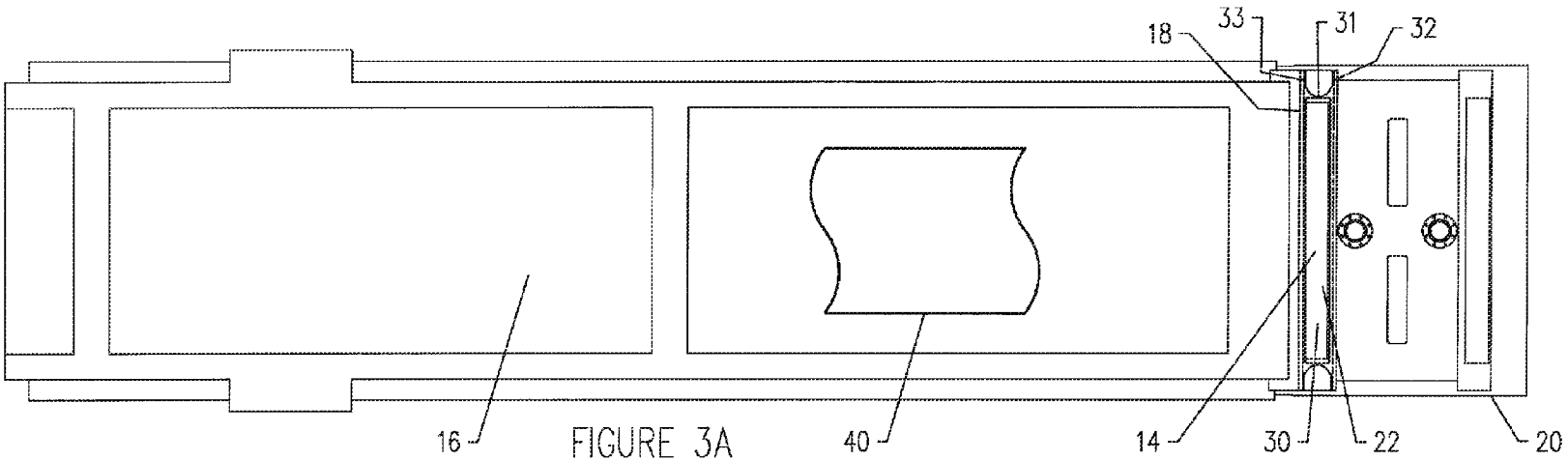
FIG. 3A is a top plan view of a portion of a pickle line assembly installation in accordance with an embodiment of the present invention.
Figure 3B:
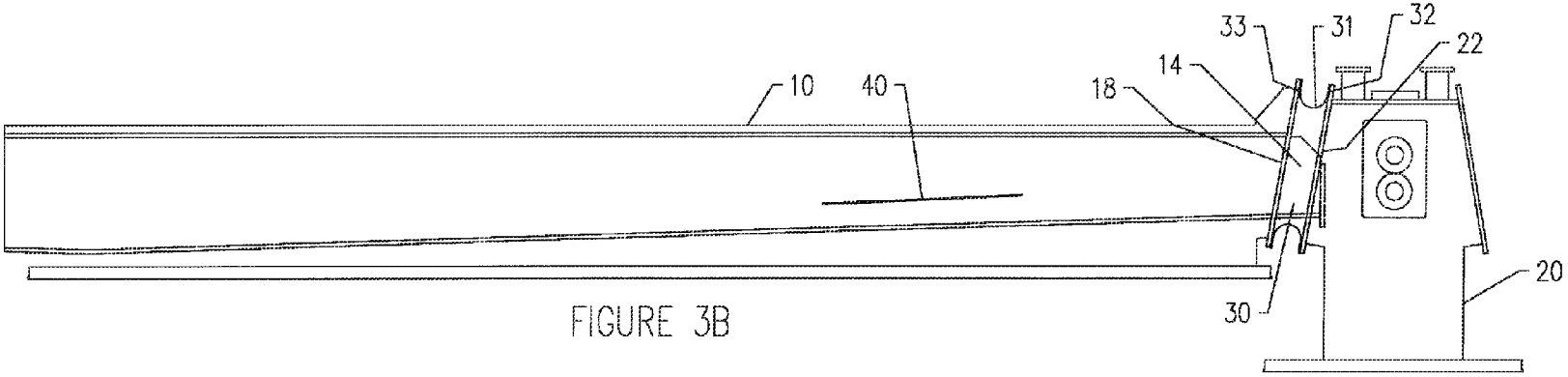
FIG. 3B is a side elevation view of the portion of the pickle line assembly installation of FIG. 3A in accordance with an embodiment of the present invention.

FIG. 3A is a plan view of a pickle line assembly having pickle tank 10 and roll tank 20 in accordance with an embodiment of the present invention. FIG. 3B illustrates an elevation view of the pickle line assembly of FIG. 3A.

As illustrated in FIGS. 3A and 3B, the opening 14 of the pickle tank 10 is in registration with the opening 22 of the roll tank 20. The opening 14 of the pickle tank 10 includes an expansion seal 30. As illustrated, it can be seen that the expansion seal 30 surrounds the junction between the roll tank 20 and pickle tank 10. That is, the expansion seal substantially surrounds a perimeter of the opening 14 of the pickle tank, such that when the pickle tank is lowered into registration with the opening 22 of the roll tank 20, the expansion seal encloses the path between the cavity 16 of the pickle tank 10 and the roll tank 20 along which the pickling material 40 travels, which prevents leakage of pickling solution and prevents hazardous fumes from escaping the assembly.

Figure 4C:
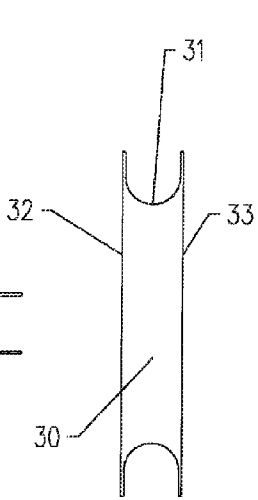
FIG. 4C is a side elevation view of a seal of a pickle line assembly in accordance with an embodiment of the present invention.
Figure 4B:
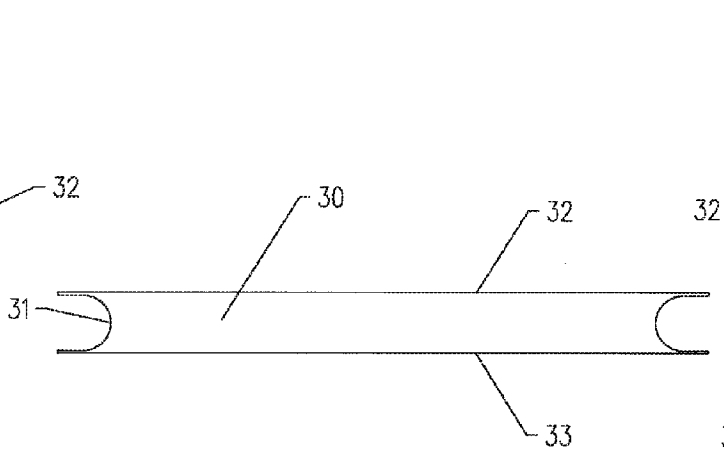
FIG. 4B is a top plan view of a seal of a pickle line assembly in accordance with an embodiment of the present invention.
Figure 4A:
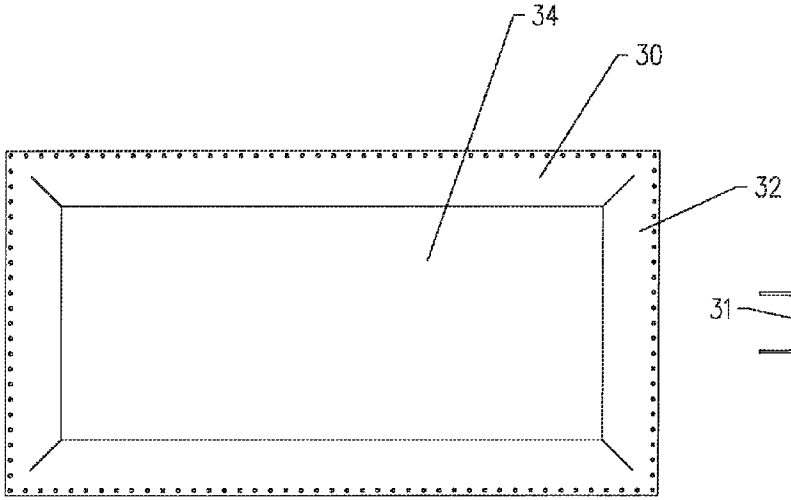
FIG. 4A is a front elevation view of a seal of a pickle line assembly in accordance with an embodiment of the present invention.

A front elevation view of an embodiment of expansion seal 30 in isolation (i.e., without the other parts of the pickle line assembly) is illustrated in FIG. 4A. FIG. 4B is a top plan view of expansion seal 30, and FIG. 4C is a side elevation view of expansions seal 30. Expansion seal 30 surrounds an opening 34 so as to enclose the path between cavity 16 of the pickle tank 10 and the roll tank 20 and eliminate the need for closure plates. The expansion seal 30 further includes a first face 32 and a second face 33. The first face 32 is directed away from the midpoint of a length of the pickle tank 10 and the second face is directed towards the midpoint of the length of the pickle tank 10. In accordance with one embodiment of the present invention, the expansion seal 30 creates a substantially air-tight and/or water-tight seal between the roll tank 20 and the pickle tank 10.

Pickle tank 10 is frequently made of a plastic (e.g., polypropylene) or other material that is subject to significant expansion and contraction due to the pickling solution and any heating or cooling of the tank 10. Therefore, the expansion seal 30 can include a flexion portion 31, which facilitates a displacement or compression of the first face 33 toward the second face 32 when the expansion seal 30 is disposed between the pickle tank 10 and roll tank 20. While the flexion portion 31 is illustrated in FIGS. 4A-4C as a surface curved toward an inner portion of the expansion seal 30, a person of ordinary skill in the art would understand in view of this disclosures that other configurations can be employed to form the flexion portion 31, such as a surface curved away from the inner portion of the expansion seal 30 or a variation in the thickness of the expansion seal 30 designed to encourage the expansion seal 30 to buckle at the flexion portion 31 under the compressive force between the first face 32 and second face 33 (e.g., a decreased thickness of the seal at flexion portion 31). Additionally, the expansion seal 30, or a portion thereof, can be formed from a compressible material.

The expansion seal 30 can be integrated into the pickle tank 10. Alternatively, the expansion seal can be a separate piece of the assembly that is interposed between the roll tank 20 and pickle tank 10 during installation. If the expansion seal 30 is integrated into the pickle tank 10, the pickle tank 10 can include a plate 18 for interfacing the second surface 33 of the expansion seal 30. While plate 18 provides leverage and compressive force against the expansion seal as it is pressed into the face of the roll tank 20, a person of ordinary skill in the art would understand that the expansion seal 30 could be affixed to the outer surface of the pickle tank 10 along the rectangular (or otherwise) perimeter.

In a further alternative, the expansion seal 30 can be integrated into the roll tank 20 (e.g., affixed to the front face 24 and rear face 25) by ensuring that the angle of the second face 33 of the expansion seal is angled at approximately 45° or more relative to vertical. At this angle, the pickle tank 10 could be lowered directly into registration with the roll tank 20 within interference from the expansion seal 30. It should be noted that requiring an angle of 45° or greater relative to vertical effectively shortens the distance from roll tank 20 to roll tank 20. This could result in a decreased time in solution. The change distance can be offset by increasing the total length of the pickle tank and increasing the roll-to-roll distance or by increasing the number of pickle tanks in the assembly.

The expansion seal 30 can be attached to the pickle tank 10 or roll tank 20 by mechanical fasteners (e.g., screws, bolts, clips, etc.) or chemical processes (e.g., adhesives, heat fusing, etc.). Alternatively, if the expansion seal 30 is not an integral part of either the pickle tank 10 or roll tank 20, the expansion seal 30 can be attached to both the pickle tank 10 and roll tank 20 by either mechanical fasteners or chemical processes during installation. The mechanical fasteners or chemical processes used to couple the expansion seal to the pickle tank 10 and roll tank 20 are preferably resistant to the pickling solution.

Figure 5B:
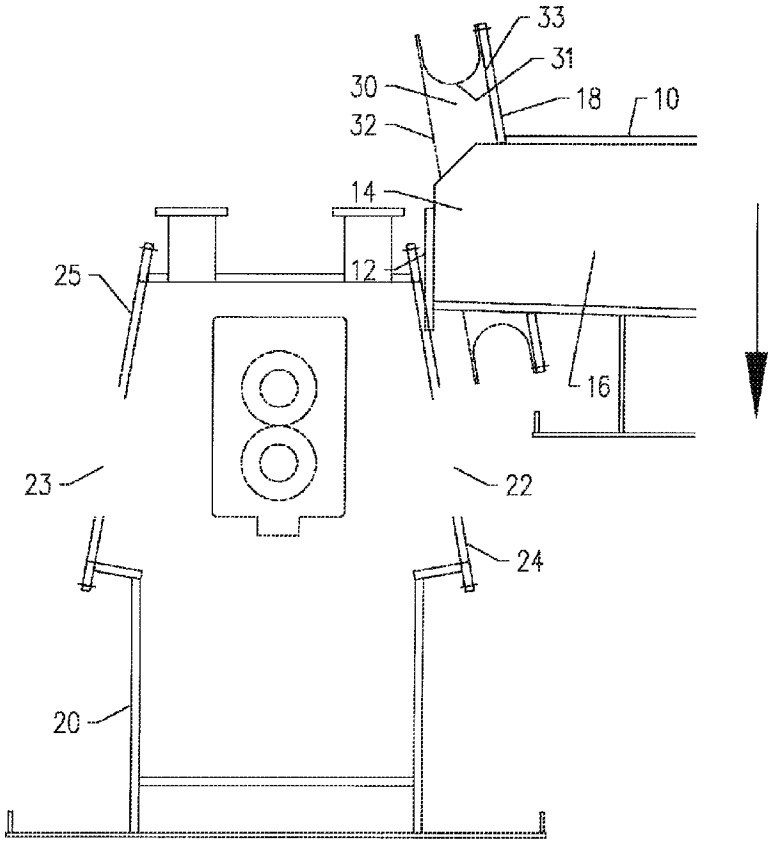
FIG. 5B is a further cross-section elevation view of the pickle tank and roll tank of FIG. 5A during installation of the pickle line assembly in accordance with an embodiment of the present invention.
Figure 5A:
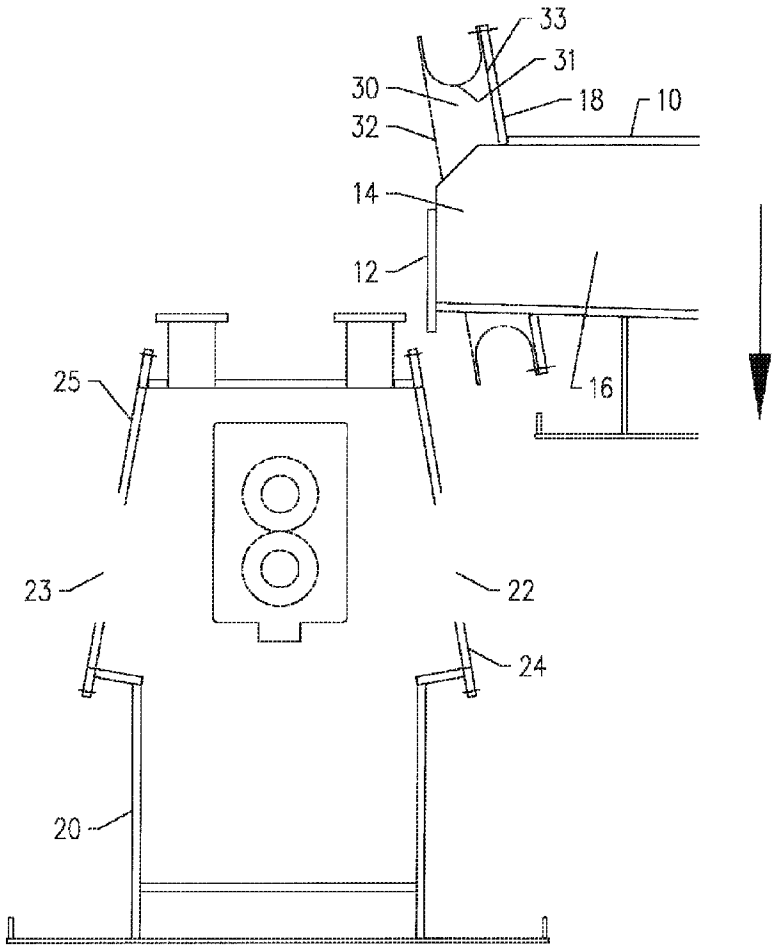
FIG. 5A is a cross-section elevation view of a pickle tank and roll tank during installation of the pickle line assembly in accordance with an embodiment of the present invention.

FIG. 5A is a cross-section elevation view of a pickle tank and roll tank during installation of the pickle line assembly in accordance with an embodiment of the present invention. That is, FIG. 5A illustrates a pickle tank assembly in one phase of installation when the pickle tank 10 is elevated above roll tank 20. From this position, the pickle tank 10 can be installed in the assembly by lowering the pickle tank 10 along a vertical path until the opening 14 of pickle tank 10 is in registration with the opening 22 of roll tank 20. In this illustration, the expansion seal 30 is integral to the pickle tank 10. However, as discussed above, a person of ordinary skill in the art would understand that that the expansion seal 30 could be integrated into the roll tank 20 (as discussed below) or freely movable such that it is placed in between the roll tank 20 and pickle tank 10 during installation.

The roll tank 20 includes a front face 24 and a rear face 25 having respective openings 22 and 23. The designation of front and rear is used as a convenience and does not denote any specific functionality or limitation. The front face 24 and rear face 25 are angled relative to vertical such that the top of the front face 24 and rear face 25 are closer together at the top than the bottom. That is, the front face 24 and rear face 25 can be thought of as forming the legs of a trapezoid. As illustrated, the tilt angle of the front face 24 and rear face 25 are congruent such that the front face 24 and rear face 25 form the legs of an isosceles trapezoid. This symmetrical configuration allows for manufacturing efficiency and ease of assembly, in part, because the pickle tank 10, which interfaces the roll tank, may also be symmetrical with respect to each end of the pickle tank 10. However, a person of ordinary skill in the art would understand that the tilt angle of the front face 24 and rear face 25 can be different from one another.

Pickle tank 10 further includes a flange 12, which extends horizontally beyond the lower portion of expansion seal 30 and extends into the cavity of roll tank 20 so as to minimize spillage of pickling solution. Because of the tilt angle of the front face 24 and rear face 25, as the pickle tank 10 is raised and lowered into registration with the roll tank 20, the flange 12, and pickle tank in general, is not obstructed by the front face 24 and rear face 25. That is, the pickle tank 10 can be raised or lowered along a vertical line, such that the flange 12 and pickle tank 10 clear the opening 22 of the front face 24. No horizontal adjustment of the pickle tank 10 is required to raise or lower the pickle tank 10 out of registration with the roll tank 20. This can be achieved by ensuring the flange 12 does not extend beyond the top of the opening 22 of the front face 24.

The expansion seal 30 is preferably attached to the pickle tank 10 at a predetermined angle relative to vertical. The tilt angle of the expansion seal 30 can be defined by the tilt angle of plate 18 or by the shape of the expansion seal 30. In one embodiment, the tilt angle of the first surface 32 is substantially the same as the tilt angle of the front face 24 so that the first surface 32 and front face 24 are aligned and flush when the pickle tank 10 is lowered. The angle of expansion seal 30 and the wall surrounding opening 22 should be sufficient to provide clearance for the flange 12 as the pickle tank 10 is lowered into position. In accordance with one embodiment of the present invention, the incline of the expansions seal 30 is approximately 10 degrees or greater. Alternatively, the tilt angle of the first surface 32 of the expansion seal 30 can vary from the tilt angle of the font face 24 if, when moved into registration with the roll tank 20, the expansion seal 30 deforms so that the first surface 32 aligns with the front surface 24.

As the pickle tank 10 is lowered, the flange 12 near the opening 14 enters the opening 22 of the front face 24 and overhangs the bottom of the opening 22. FIG. 5B is a cross-section elevation view of a further phase of installation, and illustrates the pickle tank 10 as the flange begins to enter the opening 22 (i.e., break the plane defined by the front surface 24). FIG. 5C is a cross-section elevation view of yet a further phase of installation.

Figure 5D:
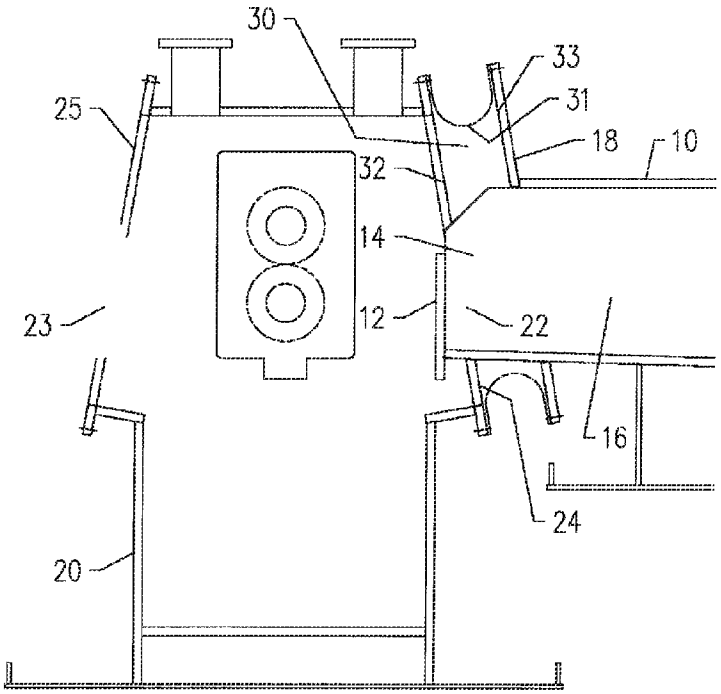
FIG. 5D is a further cross-section elevation view of the pickle tank and roll tank of FIG. 5A during installation of the pickle line assembly in accordance with an embodiment of the present invention.
Figure 5C:
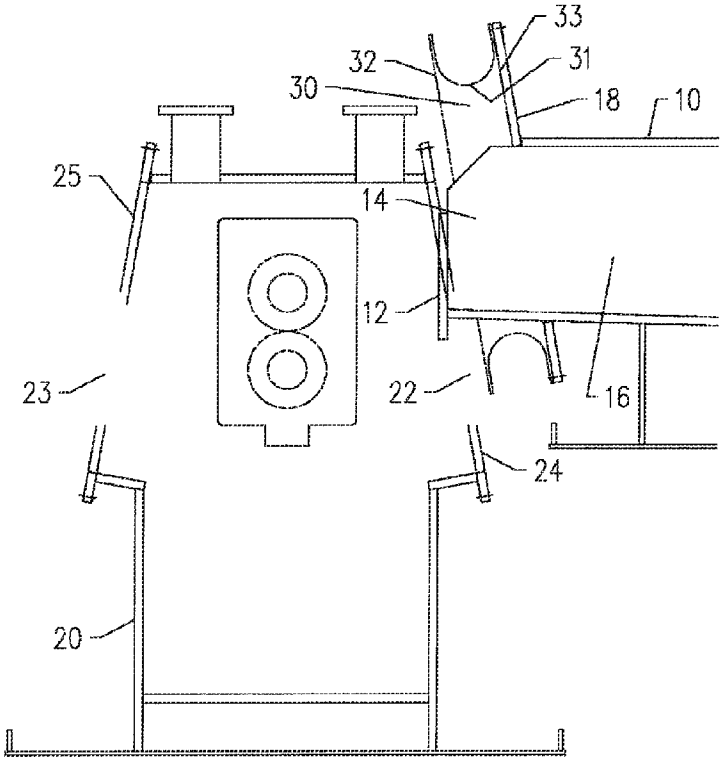
FIG. 5C is a further cross-section elevation view of the pickle tank and roll tank of FIG. 5A during installation of the pickle line assembly in accordance with an embodiment of the present invention.
Figure 5E:
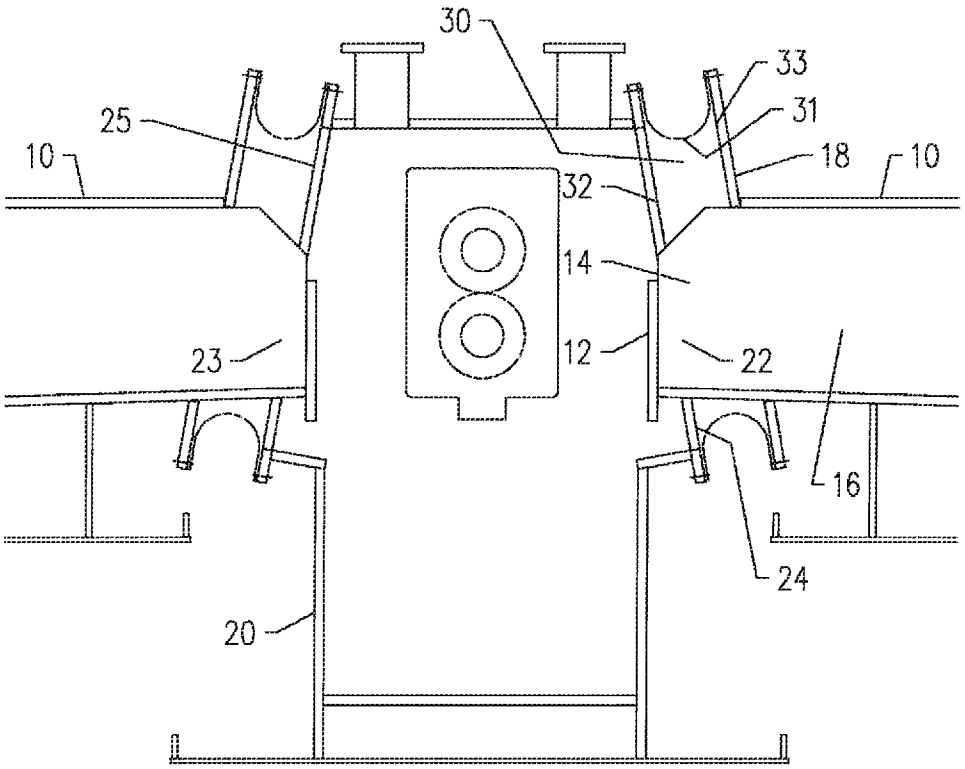
FIG. 5E is a further cross-section elevation view of the pickle tank and roll tank of FIG. 5A having a second pickle tank installed in accordance with an embodiment of the present invention.

FIG. 5D is a cross-section elevation view of the pickle line assembly after the pickle tank 10 is fully lowered into registration with the roll tank 20. FIG. 5E is a cross-section elevation view of the pickle line assembly after a pickle tank 10 has been lowered into registration with opening 22 of front face 24 and pickle tank 10' has been lowered into registration with opening 23 of front face 25.

The configuration of the pickle line assembly illustrated in FIGS. 5A-5E allows for easy assembly and movement of the pickle tanks 10 and 10' into and out of position in the pickle line assembly. Additionally, the configuration accommodates expansion and contraction of the components of the pickle line assembly. Furthermore, potentially hazardous fumes and chemicals are better contained during operation of the pickling line assembly.

The foregoing Detailed Description is to be understood as being in every respect illustrative and exemplary, but not restrictive, and the scope of the invention disclosed herein is not to be determined from the Detailed Description, but rather from the claims as interpreted according to the full breadth permitted by the patent laws. It is to be understood that the embodiments shown and described herein are only illustrative of the principles of the present invention and that various modifications may be implemented by those skilled in the art without departing from the scope and spirit of the invention. Those skilled in the art could implement various other feature combinations without departing from the scope and spirit of the invention.

I claim:

1. A pickle line assembly comprising:

a first roll tank having a front face and a rear face angled relative to vertical such that an upper end of the front face and an upper end of the rear face are closer to each other than a lower end of the front face and a lower end of the rear face, each of the front face and the rear face defining an opening for receiving a pickling material;

a pickle tank defining an internal cavity for transport of the pickling material and a first opening and a second opening;

a first expansion seal having a first surface for interfacing the first roll tank and a second surface for interfacing the pickle tank, the first expansion seal configured to surround a perimeter of the first opening of the pickle tank, the first surface of the first expansion seal being oriented at an angle that aligns with the angle of the front face of the first roll tank, wherein, when assembled, the first surface of the first expansion seal mates with the front face of the first roll tank to form a first interface and the second surface of the first expansion seal mates with the pickle tank to form a second interface and wherein the first expansion seal is compressed between the front face and the pickle tank such that a thickness of the first expansion seal is decreased due to the compression to form an air-tight and water-tight seal at the first and second interfaces and wherein the first opening of the pickle tank is in registration with the opening of the front face of the first roll tank such that the first expansion seal encloses a path between the pickle tank and the first roll tank, the first expansion seal deforms so that the first surface aligns with the front face when in registration with the first roll tank; and a first flange extending beyond a lower portion of the first expansion seal so that, when assembled, the first flange extends through the plane of the front face of the first roll tank into an interior of the first roll tank, wherein the first flange extends between a lower portion and an upper portion of the opening of the front face of the first roll tank, such that the pickle tank can be vertically raised and lowered absent interference between the pickle tank and the upper portion of the front opening of the first roll tank.

2. The pickle line assembly of claim 1, wherein the first expansion seal is affixed to the pickle tank so as to form an integral part of the first opening of the pickle tank.

3. The pickle line assembly of claim 1, wherein the first expansion seal comprises a compressible material.

4. The pickle line assembly of claim 3, wherein the first expansion seal deforms so as to create a seal with the first roll tank that is substantially air-tight and water tight.

5. The pickle line of assembly of claim 1, wherein the first expansion seal is coupled to the front face of the first roll tank by a plurality of fasteners.

6. The pickle line assembly of claim 1, wherein the pickle tank further comprises a second expansion seal configured similar to the first expansion seal about the second opening of the pickle tank, such that when assembled, the second opening of the pickle tank is in registration with the opening of the rear face of a second roll tank such that the second expansion seal encloses a path between the pickle tank and the second roll tank, the assembly further comprising a plurality of roll tanks and a plurality of pickle tanks arranged in a pattern of alternating pickle tanks and roll tanks.

7. A pickle line assembly comprising: a roll tank comprising:

a front face defining an opening for receiving a pickling material and angled relative to vertical; and a rear face defining an opening for receiving the pickling material and angled relative to vertical, such that an upper end of the front face and an upper end of the rear face are closer to each other relative to a lower end of the front face and a lower end of the rear face; and a pickle tank defining an internal cavity for transport of the pickling material, a first opening, and a second opening wherein the first opening of the pickle tank is aligned with the front opening of the roll tank to enable flow of pickling material to the roll tank; and a first expansion seal having a first surface for interfacing the roll tank and a second surface for interfacing the pickle tank, the first expansion seal configured to surround a perimeter of the first opening of the pickle tank, the first surface of the first expansion seal being oriented at an angle that aligns with an angle of the front face of the roll tank, wherein, when assembled, the first surface of the first expansion seal mates with the front face of the roll tank to form a first interface and the second surface of the first expansion seal mates with the pickle tank to form a second interface and wherein the first expansion seal is compressed between the front face and the pickle tank such that a thickness of the first expansion seal is decreased due to the compression to form an air-tight and water-tight seal at the first and second interfaces, the first expansion seal deforms so that the first surface aligns with the front face when in registration with the first roll tank; and a rear expansion seal affixed to the rear face at an angle relative to vertical and configured to surround a perimeter of the opening of the rear face, wherein the opening of the front expansion seal and the opening of the rear expansion seal are configured to allow a pickle tank to be vertically lowered into registration with the front and rear openings without interference from the front and rear expansion seal.

8. The pickle line assembly of claim 7, wherein the front expansion seal is affixed to the roll tank and the rear expansion seal is affixed to the roll tank so as to form an integral part of the respective front and rear opening of the roll tank.

9. The pickle line assembly of claim 7, wherein the front and rear expansion seal deform so as to create a seal with a roll tank that is substantially air-tight and water tight.

10. The pickle line assembly of claim 7, wherein the front expansion seal is coupled to the front face by a first plurality of fasteners and the rear expansion seal is coupled to the rear face by the plurality of fasteners.

* * * * *